US009799987B2

(12) United States Patent
Gerhardt

(10) Patent No.: US 9,799,987 B2
(45) Date of Patent: Oct. 24, 2017

(54) CONNECTOR

(71) Applicant: Continental Automotive GmbH, Hannover (DE)

(72) Inventor: Marc Gerhardt, Dortmund (DE)

(73) Assignee: Continental Automotive GmbH, Hannover (DE)

( * ) Notice: Subject to any disclaimer, the term of this patent is extended or adjusted under 35 U.S.C. 154(b) by 0 days.

(21) Appl. No.: 15/103,373

(22) PCT Filed: Nov. 24, 2014

(86) PCT No.: PCT/EP2014/075362
§ 371 (c)(1),
(2) Date: Jun. 10, 2016

(87) PCT Pub. No.: WO2015/086299
PCT Pub. Date: Jun. 18, 2015

(65) Prior Publication Data

US 2016/0315417 A1 Oct. 27, 2016

(30) Foreign Application Priority Data

Dec. 10, 2013 (DE) ..... 10 2013 225 449

(51) Int. Cl.
*H01R 13/58* (2006.01)
*H01R 13/506* (2006.01)
*H01R 13/53* (2006.01)

(52) U.S. Cl.
CPC ..... *H01R 13/5829* (2013.01); *H01R 13/506* (2013.01); *H01R 13/53* (2013.01)

(58) Field of Classification Search
CPC .. H01R 13/58; H01R 13/5812; H01R 13/582; H01R 13/506; H01R 13/5837; H01R 13/5804; H01R 13/516; H01R 13/5825; H01R 13/53; H01R 13/5829
USPC ..... 439/460
See application file for complete search history.

(56) References Cited

U.S. PATENT DOCUMENTS 1,993,391 A * 3/1935 Weaver, Jr. ..... H01R 4/32 24/135 R
5,380,220 A 1/1995 Okabe
5,573,430 A * 11/1996 Hatagishi ..... H01R 13/506 439/400
5,617,630 A * 4/1997 Kobayashi ..... H01R 43/20 29/857
5,669,763 A 9/1997 Pryce et al.
6,036,550 A 3/2000 Naganawa et al.
6,402,568 B1 * 6/2002 Nagai ..... H01R 13/506 439/701

(Continued)

FOREIGN PATENT DOCUMENTS

DE 43 40 066 A1 5/1994
WO WO 97/44862 A1 11/1997

*Primary Examiner* — Xuong Chung Trans
(74) *Attorney, Agent, or Firm* — Cozen O'Connor

(57) ABSTRACT

A plug connector for an electrical connection has at least two electrical lines, the ends of which are connected to contact elements, includes: a housing that encompasses the electrical lines and the contact elements at least in a region of connecting the electrical lines to respective contact elements; and a holder fixedly connected to the housing. The holder has receptacles configured to hold the electrical lines, the receptacles holding the lines such that the lines cannot move out of position.

10 Claims, 2 Drawing Sheets

(56) References Cited

U.S. PATENT DOCUMENTS 9,130,306 B2 * 9/2015 Hotea ..... H01R 13/506

* cited by examiner

CONNECTOR

CROSS-REFERENCE TO RELATED APPLICATIONS

This is a U.S. national stage of application No. PCT/EP2014/075362, filed on 24 Nov. 2014, which claims priority to the German Application No. 10 2013 225 449.0 filed 10 Dec. 2013, the content of both incorporated herein by reference.

BACKGROUND OF THE INVENTION

1. Field of the Invention

The present invention relates to a plug connector for an electrical connection having at least two electrical lines, the ends of which are connected to contact elements, and having a housing that encompasses the electrical lines and the contact elements at least in the region of their connecting site.

2. Related Art

Such plug connectors are used in supply units in motor vehicles to connect electrical assemblies, such as the fuel pump and fuel level sensor, that are arranged in the fuel container of the motor vehicle. In order to produce the electrical connection, the electrical lines are inserted through the flange of the supply unit in the fuel container. The flange comprises a socket for this purpose and the electrical lines are inserted into the socket. The socket penetrates the flange so that the lines are inserted into the socket at the outer face of the flange, whereas the socket is connected on the inner face of the flange to a plug connector in order to guide the electrical lines onwards as far as the respective electrical components. Swashing movements of the fuel in the fuel container lead to the fact that the electrical lines that are freely routed in the proximity of the flange are excited into movements that are transmitted to the contact elements in the plug connector and the socket. A disadvantage of this is that the movements of the electrical lines lead to a relative movement between the contact elements in the plug connector and the socket. Insofar as the contact elements are wetted by the fuel, this relative movement is not critical. If the fuel fill level in the fuel container drops, the amount of dry friction increases and this leads to friction corrosion and as a result associated contact failures. It is known for this reason to provide the contact elements with additional coatings that counteract the friction corrosion. However, applying the coatings has the disadvantage that contact elements that are protected in this manner are encumbered by very high costs.

SUMMARY OF THE INVENTION

It is therefore an object of the invention to provide a plug connector that is resistant to friction corrosion in a cost-effective manner.

The object is achieved, according to an aspect of the invention, by virtue of the fact that the plug connector has a holder fixedly connected to the plug connector and by virtue of the fact that the holder has receptacles for the electrical lines and the receptacles hold the lines such that they cannot move out of position.

In addition to the holding device of the contact elements in the housing of the plug connector, a second fixing arrangement is produced by virtue of the arrangement of receptacles for holding the electrical lines such that the electrical lines cannot move out of position. By virtue of this second fixing arrangement positioned upstream of the holding device of the contact elements, movements, which are caused during operation, of the electrical lines that are arranged inside the fuel container are only possible as far as the receptacles as the second fixing arrangement. In addition, the electrical lines are decoupled up to the contact elements from the movements of the electrical lines as a result of the receptacles, so that the contact elements are mounted in the housing of the plug connector as a first fixing arrangement in a movement-free manner. As a consequence a relative movement of the contact elements with respect to the contact elements in the socket of the flange is impeded, so that friction corrosion does not occur. The electrical connection is thus reliable and protected without having to provide additional coatings. A further advantage resides in the fact that the holder is structured in a relatively simple manner and is thus cost-effective.

In one advantageous embodiment, the holder is connected to the plug connector by a latching connection. The latching connection facilitates the process of reliably fixing the holder on the plug connector. A further advantage resides in the fact that the latching connection renders it possible to easily release the connection during the course of maintenance and repair work.

The electrical lines are fixed in the holder in a simple manner by virtue of the fact that the receptacles have a cross-section that is smaller than the diameter of the respective electrical line. As a result of the smaller cross-section, the electrical lines are arranged by a press-fit in the receptacles, as a consequence of which movements are prevented from being transmitted to the contact elements in the plug connector.

The receptacles can be embodied as bore holes through which the electrical lines are guided. In contrast, a considerably simpler process of assembling the electrical lines in the receptacles of the holder is achieved using a holder in which the cross-sections of the receptacles are open to one side.

In an advantageous embodiment, each receptacle is defined on its open side by two protrusions. The protrusions act as a latching step and ensure that the lines are held securely in the receiving devices.

The process of assembling the lines can be further simplified if the open side of each receptacle is embodied as a slot. These slots render it possible to push the electric lines into the respective receptacle.

So as not to greatly impair the structure and strength of the holder, the slots can be oriented, in a further embodiment, facing multiple sides of the holder.

The process of assembling the electrical line can be further simplified if on the holder each receptacle is allocated an insertion incline that renders it possible to easily insert the respective electrical line into the receptacle.

In a further embodiment, the electrical lines are inserted into the receptacles or into the associated insertion inclines. Subsequently, the holder is connected to the plug connector. If the holder and/or the housing of the plug connector has shaped elements that render it possible to connect the holder to the plug connector in only one orientation, the holder is prevented from making an incorrect contact with the plug connector as a result of the holding means being placed on the plug connector in a twisted manner. Such shaped elements can be formed, for example, by an asymmetrical design of the holding part that cooperates with the corresponding protrusions on the housing of the plug connector.

In accordance with a further advantageous embodiment, the assembly process is considerably facilitated if the holder is connected to the plug connector in a captive manner, preferably by a film hinge. As a consequence, the electrical lines can be inserted and the holder subsequently fixed to the plug connector.

BRIEF DESCRIPTION OF THE DRAWINGS

The invention is further explained with reference to an exemplary embodiment. In the drawings.

DETAILED DESCRIPTION OF THE PRESENTLY PREFERRED EMBODIMENTS

Figure 1:
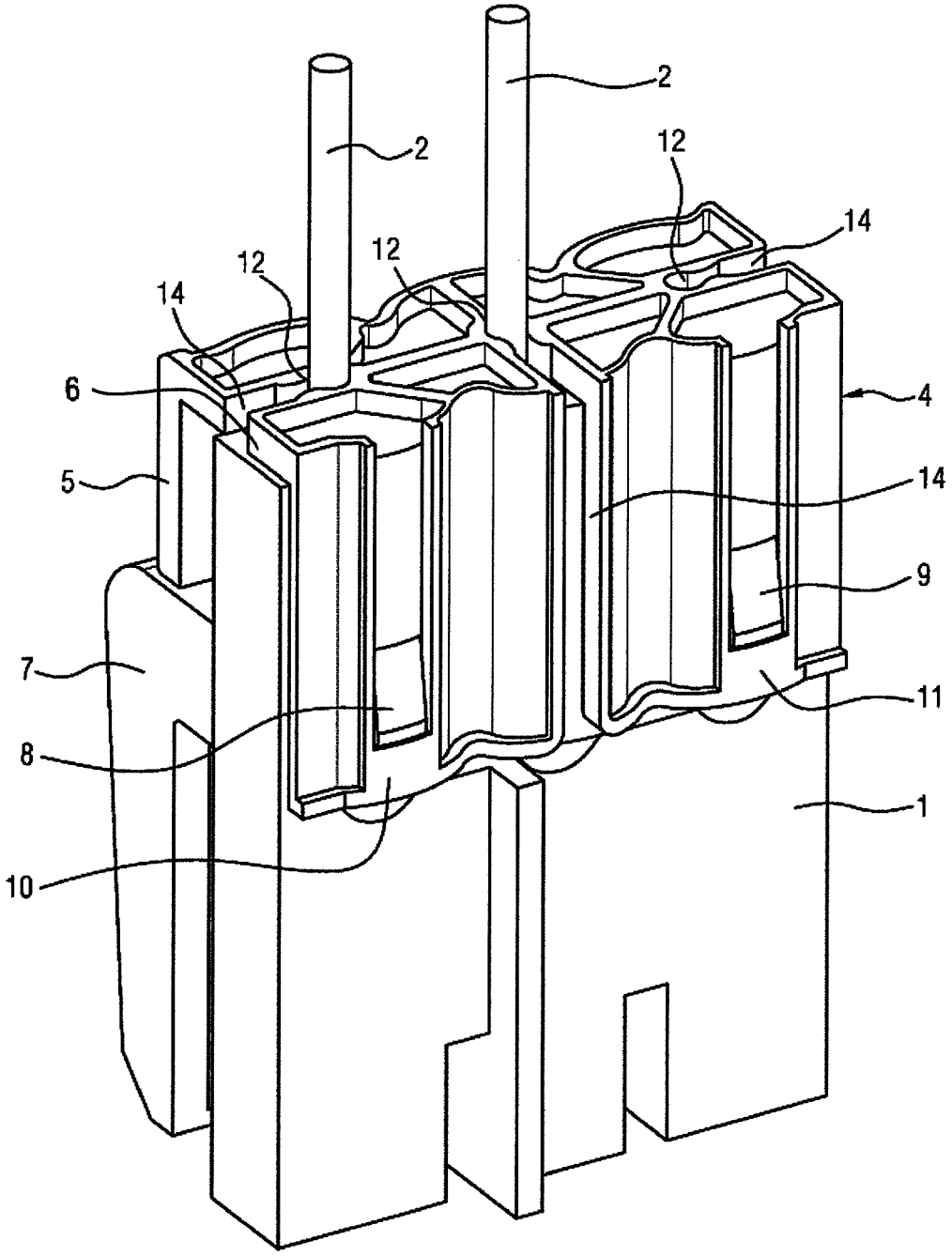
FIG. 1: illustrates a plug connector in accordance with the invention.

The plug connector in FIG. 1 includes a housing 1 that encompasses electrical lines 2 and their contact elements in the region of their connection site. A U-shaped holder 4 is arranged on the plug connector and a limb 5, 6 of the holder 4 encompasses the housing 1 in the region of the electrical lines 2. The limb 5 is shorter than the limb 6 and extends in the assembled state as far as a protrusion 7 of the housing 1. By virtue of this design, the holder 4 can only be fixed to the housing 1 in one orientation so that an incorrect contact as a result of twisting is not possible. The fixing arrangement is produced by a latching connection formed by two latching hooks 8, 9 on the housing 1 and two latching steps 10, 11 on the limb 6. The holder 4 comprises three receptacles 12 for the electrical lines 2 of which two are illustrated. The receptacles 12 have a cross-section that is slightly smaller than the diameter of lines 2. As a consequence, the electrical lines 2 are clamped in the receptacles 12 and are thus held such that the lines cannot move out of position so that the part of the electrical lines 2 that is located in the housing 1 cannot perform any movements even if the regions of the electrical lines 2 that are located above the plug connector are moved.

Figure 2:
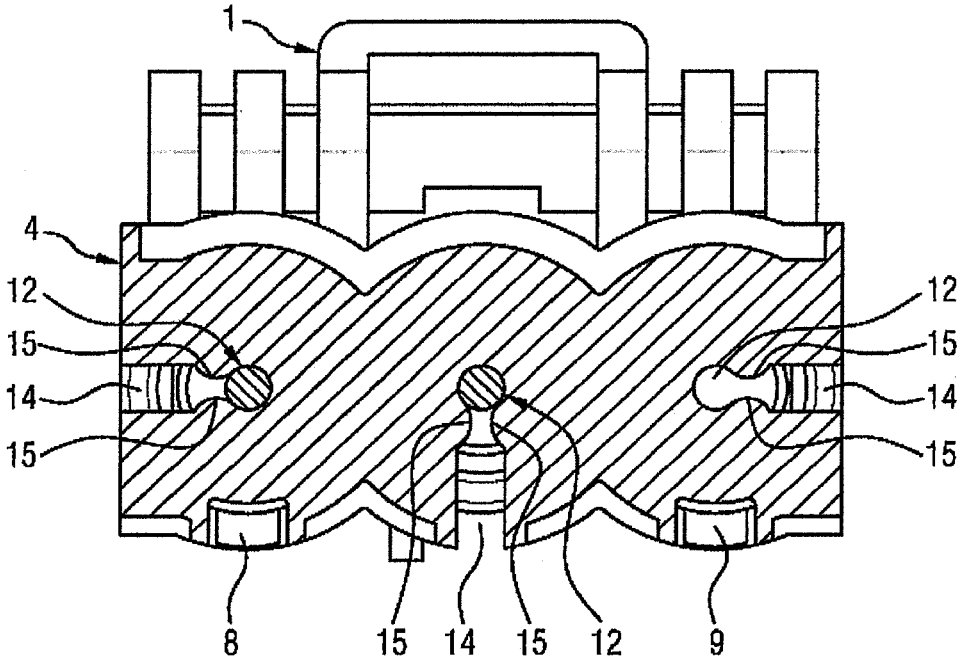
FIG. 2: illustrates a cross-sectional view of the plug connector.

FIG. 2 illustrates a cross-sectional view through a base 13 of the U-shaped part of the holder 4 that connects the two limbs 5, 6 to one another. Three receptacles 12 are embodied in the base 13, on which two are already holding, in each case, an electrical line. The cross-sections of the receptacles 12 are each open to one side of the base 13. In this embodiment, three sides are each provided with one slot 14, which results in only a slight weakening of the structure of the holder 4. These slots 14 render it possible to insert the electrical lines 2 laterally from the edge of the holder 4 into the respective receptacle 12. The receptacles 12 are separated from a respective slot 15 by in each case two protrusions 15. As a consequence, the slots 15 can be wider so as to facilitate the process of inserting the lines 2 and the receptacles encompass the lines 2 with a greater angular range. In addition, the protrusions 15 act as a latching step that emits a haptic message if the respective electrical line 2 is arranged in the receptacle 12 in a proper manner.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

The invention claimed is:

1. A plug connector for an electrical connection having at least two electrical lines, the ends of which are connected to contact elements, the plug connector comprising:

a housing (1) that encompasses the electrical lines and the contact elements at least in a region of connecting the electrical lines to respective contact elements, the housing (1) having a protrusion (7) arranged on only one side of the housing (1); and a holder (4) fixedly connectable to the housing, the holder (4) having receptacles (12) configured to hold the electrical lines (2), the receptacles holding the lines (2) such that the lines cannot move out of position, the holder having a first limb (5) and a second limb (6), the first limb (5) being shorter than the second limb (6), the first limb (5), in an assembled state of the plug connector, extending as far as the protrusion (7) of the housing (1) such that the holder (4) can only be fixed to the housing (1) in one orientation.

2. The plug connector as claimed in claim 1, wherein the holder (4) is connected to the housing (1) by a latching connection (8-11).

3. The plug connector as claimed in claim 2, wherein the receptacles (12) each have a cross-section smaller than a diameter of the respective electrical line (2) held by the respective receptacle.

4. The plug connector as claimed in claim 3, wherein the cross-section of the receptacle (12) is open at one side (14).

5. The plug connector as claimed in claim 4, wherein each of the receptacles (12) is defined at its open side by two protrusions (15).

6. The plug connector as claimed in claim 2, wherein each of the receptacles (12) is allocated an insertion incline (14) on the holder (4).

7. The plug connector as claimed in claim 2, wherein the holder (4) is one selected from the group of cup-shaped and U-shaped such that, in either case, the holder (4) encompasses the housing (1) in a region of the electrical lines (2).

8. The plug connector as claimed in claim 2, wherein the holder (4) is connected to the housing (1) non-detachably.

9. The plug connector as claimed in claim 8, wherein the non-detachable connection is by a film hinge.

10. The plug connector as claimed in claim 2, wherein the holder (4) is U-shaped.

* * * * *